United States Patent [19]

Johnson et al.

[11] 4,328,114

[45] May 4, 1982

[54] DETERGENT COMPOSITIONS AND PROCESSES FOR MANUFACTURING THEM

[75] Inventors: Richard S. Johnson; John K. Potter, both of Wirral, England

[73] Assignee: Lever Brothers Company, New York, N.Y.

[21] Appl. No.: 200,791

[22] Filed: Oct. 27, 1980

[30] Foreign Application Priority Data

Oct. 31, 1979 [GB] United Kingdom ..... 37630/79

[51] Int. Cl.[3] ..... C11D 3/06; C11D 7/42

[52] U.S. Cl. ..... 252/135; 252/139; 252/174.11; 252/174.13; 252/174.21

[58] Field of Search ..... 252/135, 139, 174.11, 252/174.13, 174.21

[56] References Cited

U.S. PATENT DOCUMENTS 3,714,051 1/1973 Milesi et al. ..... 252/135

4,217,253 8/1980 Schmitt ..... 252/174.11 X

*Primary Examiner*—Mayer Weinblatt

*Attorney, Agent, or Firm*—Irving N. Feit; James J. Farrell; Melvin H. Kurtz

[57] ABSTRACT

A process for producing absorbent granules from sodium tripolyphosphate or disodium hydrogen orthophosphate by simultaneously granulating and hydrating the salts to full hydration. The process produces granules which have good absorbency without the need for a drying step. The granules can be used for absorbing liquid nonionic surfactant or other liquid components of detergent powders such as perfumes.

2 Claims, No Drawings

DETERGENT COMPOSITIONS AND PROCESSES FOR MANUFACTURING THEM

This invention relates to adjuncts for use in the manufacture of detergent powders, and to processes for preparing these adjuncts.

It is considered probable that in the future some detergent powders will be manufactured not, as now, by spray-drying of aqueous detergent slurries, but by a so-called 'dry-mixing' route, in which the proportion of liquid and absorbent components of the composition is balanced and dry, free-flowing granules result. Also, in some current products, particularly those with a high nonionic surfactant content, it is desirable to add a significant proportion of the surfactant separately from the spray-drying process. There are, however, very considerable technical difficulties involved in achieving an entirely satisfactory partly or wholly 'dry-mixed' product; also, most major manufacturers have very heavy capital investment in spray-drying towers which they are reluctant to write-off, so progress in dry-mixing technology has so far been slow.

As implied above, it is necessary in 'dry-mix' technology to convert liquid components into quasi-solid form, and the most convenient way of doing that is to absorb them on porous absorbents. The liquid component of a detergent formulation which is normally present in a substantial amount and which consequently requires absorbing is nonionic surfactant, although this invention is applicable to any other liquid detergent component, for example perfume.

The patent literature suggests that sodium tripolyphosphate can be used to absorb liquid nonionic surfactant in order to form adjuncts for use in the manufacture of detergent powders. British Pat. No. 1,466,868, for example, discloses the granulation of alkali metal and ammonium tripolyphosphates in a Marumerizer (registered trade mark). In this process tripolyphosphate is formed into a bed and granulated using an aqueous binder. The granules are then dried, for example in an oven or in a fluidised bed, the drying step serving to open pores in the granules and permit the absorption of liquid nonionic surfactant carrying an enzyme material.

We have now discovered that sodium tripolyphosphate and disodium hydrogen orthophosphate can be converted into a form in which they can absorb significantly larger quantities of liquid nonionic surfactant or other liquid components of detergent powders than in the prior proposals, and that this can be achieved without the necessity for a drying step.

According to this invention there is provided a process for the formation of an adjunct without the necessity for a drying step, the adjunct being suitable for use in the manufacture of detergent powders which comprises simultaneously granulating and hydrating sodium tripolyphosphate or disodium hydrogen orthophosphate to full hydration and subsequently adding a liquid component of a detergent powder to the granules.

In a second aspect, the invention provides an adjunct for use in the manufacture of a detergent powder comprising a liquid component of a detergent powder absorbed on granulated, substantially fully hydrated sodium tripolyphosphate or sodium dihydrogen orthophosphate.

The liquid component of a detergent powder may be any component, other than water, which it is desirable to incorporate into detergent powder, nonionic surfactants and perfumes being preferred amongst these.

Nonionic surfactants which are ethoxylates, propoxylates or mixed ethoxylate-propoxylates of primary and secondary aliphatic alcohols are the preferred type for use in this invention. Some of these are solids, some liquids and some of a waxy nature, the higher molecular weight ones tending to be solid. This invention is applicable only to the liquid materials and to those which are liquefiable at temperatures lower than about 60° C.

The phosphate salt may be granulated by any suitable method. Some of the granulation methods which we have found suitable are pan-granulation, using an apparatus such as an Eirich (registered trade mark) pan, using a drum-mixer, or a Schugi (registered trade mark) mixer.

The adjunct, once formed, may be admixed with any desired detergent powder component to form a fully formulated detergent powder and, of course, the chemical composition of the adjunct will to a large extent determine what other components are necessary to achieve satisfactory performance. Thus, the adjunct can be admixed with one or more of the following components: anionic surfactants, nonionic surfactants, either the same or different from that, if any, in the adjunct, and a number of other minor components. Typical anionic surfactants which may be used are alkyl benzene sulphonates, primary and secondary alkyl sulphates, secondary alkane sulphonates, olefine sulphonates and soaps. Nonionic surfactants which are suitable are ethoxylates or propoxylates of primary and secondary aliphatic alcohols, containing from 8 to 25 carbon atoms and containing from 3 to 30 moles of alkylene oxide per mole of alcohol, ethoxylates of fatty alkanolamides, such as tallow monoethanolamide ethoxylated with from 1 to 10 moles of ethylene oxide per mole of alkanolamide, and the so-called 'polar' nonionic surfactants, alkylamine oxides and zwitterionic compounds (sulphobetaines, for example). These surfactants will generally be present at from 2 to 55, preferably 5 to 35% by weight of the final powder. The detergency builders may be any of the sequestrant or precipitant builders which have been suggested to replace phosphate builders, or they may be phosphate salts, or mixtures of any one of these, generally in amounts from 10 to 30% by weight in the case of phosphate builders and 10 to 35% by weight in the case of non-phosphate ones.

Examples of detergency builders which may be used are ortho-, pyro- and tripolyphosphates; aluminosilicates; carbonates, especially the sodium carbonate/calcium carbonate combination; polyphosphonates such as ethane-1-hydroxy-1,1-diphosphonate; amine carboxylates such as nitrilotriacetates and ethylene diamine tetra acetates; ether carboxylates such as oxydiacetates, oxydisuccinates, carboxymethyloxysuccinates and malonates; citrates, mellitates; and salts of polymeric carboxylic acids such as polymaleates, polyitaconates and polyacrylates. These salts will normally contain alkali metal or ammonium cations, preferably sodium.

Mixtures of sodium ortho- and tripolyphosphate are also suitable detergency builders, particularly mixtures in the ratio 10:1 to 1:5, preferably 5:1 to 1:1 tripolyphosphate and orthophosphate, in amounts of 10 to 30% by weight.

It will be appreciated that sodium tripolyphosphate or disodium hydrogen phosphate may be present in granulated or in non-granulated form, either form permitting the material to act as a detergency builder once the detergent powder has been dissolved into a wash liquor.

Other minor components may be present in conventional amounts. Examples of these include powder flow aids such as finely divided silicas, anti-redeposition agents such as sodium carboxymethylcellulose, fabric softening agents such as clays of the smectite and illite types, anti-ashing aids, starches, slurry stabilisers such as copolyethylene maleic anhydride and copolyvinylmethylether maleic anhydride, usually in salt form, inorganic salts such as sodium silicates and sodium sulphate and, usually present in very minor amounts, fluorescent agents.

If necessary or desirable, the formed adjuncts may be weathered, for example by fluidising in a fluidised bed. A suitable fluidised bed is the Anhydro bed (registered trade mark) and suitable conditions for weathering are air temperatures of 60° to 80° C. with a residence time in the bed of about 2 minutes.

The invention will be further described in the following examples.

EXAMPLE 1

The capacity of three commercial samples of sodium tripolyphosphate for absorbing Tergitol* 15-S-9, a $C_{12-15}$ secondary alcohol ethoxylated with an average of 9 moles of ethylene oxide per mole of alcohol, was measured by the method described in ASTM 1483-60. This method involves titrating the liquid detergent powder component onto the absorbent, the end-point being reached when the material just remains solid. The results are shown in Table 1.

*'Tergitol', 'Empiphos' and 'Eirich' are registered trade marks.

TABLE 1

Absorptive capacity of sodium tripolyphosphate

| STPP Supplier | Phase I content (%) | Absorptive capacity (cc/g) |
|---|---|---|
| Marchon (Empiphos)* | 10 | 0.45 |
| Kuhlmann | 0 | 0.31 |
| Bolyden | 43 | 0.36 |

*'Tergitol', 'Empiphos' and 'Eirich' are registered trade marks.

Each of these sodium tripolyphosphates were then granulated using water as the granulating agent in an Eirich pan granulator, the final granule size being 250–850μ average diameter. Two separate experiments were carried out in which the degree of hydration was brought up to 50% and 100% by weight respectively of the theoretical value. The absorptive capacity was again determined in the manner referred to above. The results of this determination are shown in Table 2.

TABLE 2

Absorptive capacity of granulated, hydrated sodium tripolyphosphate

| STPP Supplier | Absorptive capacity (cc/g) 50% hydrated | 100% hydrated |
|---|---|---|
| Marchon (Empiphos) | 0.81 | 1.04 |
| Kuhlmann | — | 0.53 |
| Bolyden | 0.53 | 0.70 |

This experiment demonstrates the increase in absorptive capacity for liquid nonionic surfactant which can be generated in sodium tripolyphosphate by simultaneous granulation and hydration to 100% of the theoretical value. In the case of the 100% hydrated material in accordance with the invention the increase in absorptive capacity amounts to between 71.1 and 131.1%.

EXAMPLE 2

In this experiment the granules produced by a process similar to that described in Example 1 were sieved and the absorptive capacity of the various sieve fractions were determined, also as described in Example 1. The results are shown in Table 3.

TABLE 3

Absorptive capacity (cc/g) of sieved fractions of granulated, hydrated sodium tripolyphosphate

| | | | | | | |
|---|---|---|---|---|---|---|
| Upper sieve size (mm) | 1.70 | 1.00 | 0.71 | 0.50 | 0.30 | 0.18 |
| Lower sieve size (mm) | 1.00 | 0.71 | 0.50 | 0.30 | 0.18 | 0.06 |
| Supplier | | | | | | |
| Marchon Empiphos | 1.0 | 1.03 | 1.09 | 1.18 | 1.14 | 0.85 |
| Bolyden | 0.63 | — | — | 0.85 | — | 0.78 |

This experiment shows that maximum absorptive capacity is obtained when granules having a diameter between 0.3 mm and 0.5 mm are used, although increased absorptive capacity is achieved throughout the size range.

EXAMPLE 3

In this experiment the tendency of absorbed liquid nonionic surfactant to bleed from sodium tripolyphosphate as received from the supplier was compared with its tendency to bleed from an adjunct comprising fully hydrated, granulated sodium tripolyphosphate.

15% by weight of a liquid nonionic surfactant (Synperonic 7*, a primary alcohol ethoxylate sold by Imperial Chemical Industries Limited) was absorbed onto granules of sodium tripolyphosphate hydrated to 100% by weight of the theoretical value (10 $H_2O$) produced as described in Example 1. It was also absorbed onto Empiphos* sodium tripolyphosphate as received from the supplier.

*'Synperonic' is a registered trade mark.
*'Tergitol', 'Empiphos' and 'Eirich' are registered trade marks.

Each of these adjuncts was then incorporated into a detergent powder which was stored for a period of 3 months at 37° C./70% relative humidity. The amount of nonionic surfactant bleeding from the detergent powder was then measured by means of the Ong test. The Ong test procedure involves measuring the liquid uptake of absorbent papers placed in contact with a liquid-bearing absorbent. The test is carried out in a 6" diameter cylindrical vessel which can be sealed against the external environment. 400 g of the liquid-bearing absorbent is taken and placed in the vessel, two weighed absorbent papers being interposed to split the powder into three equal layers. The vessel is then sealed and stored at 37° for three weeks. At the end of this time the absorbent papers are separated from the powder, any adhering material removed, and weighed. The Ong value is the gain in weight of the papers in mgs. The results are shown in Table 4.

TABLE 4

| | Nonionic content % | Ong value (mgs) |
|---|---|---|
| Granulated, 100% hydrated STPP | 15 | 19 |
| | 30 | 57 |
| Marchon Empiphos STPP | 15 | 54 |

Although all of these detergent powders would be considered acceptable, as far as bleeding propensity is concerned, it should be noticed that the Ong value of the powder containing granules having 15% by weight of nonionic surfactant absorbed thereon is almost a third of that containing ordinary Empiphos sodium tripolyphosphate as received.

We claim:

1. In a process for the formation of an adjunct suitable for incorporation into detergent powders which process comprises forming a hydratable salt into a granule and absorbing a liquid nonionic surfactant onto the granule, the improvement which comprises simultaneously granulating and hydrating sodium tripolyphosphate or disodium hydrogen orthophosphate to full hydration and subsequently adding the liquid nonionic surfactant to the granules formed thereby without carrying out an intermediate drying step whereby the sodium tripolyphosphate and disodium hydrogen orthophosphate can absorb significantly larger quantities of liquid nonionic surfactant.

2. A process according to claim 1 in which the phosphate salt is granulated to an average diameter of about 0.3 mm to 0.5 mm.

* * * * *